US006874417B2

(12) United States Patent
Blanchard

(10) Patent No.: US 6,874,417 B2
(45) Date of Patent: Apr. 5, 2005

(54) SLEEVE-SHAPED TRANSFER ELEMENT FOR ROTARY PRINTING MACHINES

(75) Inventor: Alain Blanchard, Gouvieux (FR)

(73) Assignee: Goss International Corporation, Bolingbrook, IL (US)

( * ) Notice: Subject to any disclaimer, the term of this patent is extended or adjusted under 35 U.S.C. 154(b) by 0 days.

(21) Appl. No.: 10/151,991

(22) Filed: May 21, 2002

(65) Prior Publication Data

US 2002/0170450 A1 Nov. 21, 2002

(30) Foreign Application Priority Data

May 21, 2001 (DE) ..... 101 24 599

(51) Int. Cl.[7] ..... B41F 27/00
(52) U.S. Cl. ..... 101/382.1; 101/368; 101/375
(58) Field of Search ..... 101/368, 375, 101/382, 401.1, 327, 329

(56) References Cited

U.S. PATENT DOCUMENTS

| | | | | |
|---|---|---|---|---|
| 2,949,852 A | * | 8/1960 | Schafefer | 101/375 |
| 3,146,709 A | * | 9/1964 | Bass et al. | 101/375 |
| 3,639,959 A | * | 2/1972 | Bagley et al. | 492/50 |
| 4,144,812 A | | 3/1979 | Julian | |

FOREIGN PATENT DOCUMENTS

| | | | | |
|---|---|---|---|---|
| CH | 345 023 | | 4/1960 | |
| CH | 646 377 | | 11/1984 | |
| DE | 27 00 118 C2 | | 7/1977 | |
| DE | 27 31 333 C2 | | 10/1978 | |
| EP | 0 000 410 A1 | | 1/1979 | |
| WO | 9911468 | * | 3/1999 | B41N/10/04 |

* cited by examiner

*Primary Examiner*—Andrew H. Hirshfeld
*Assistant Examiner*—Marissa Ferguson
(74) *Attorney, Agent, or Firm*—Laurence A. Greenberg; Werner H. Stemer; Ralph E. Locher

(57) ABSTRACT

A sleeve-shaped printing element for mounting on a carrying cylinder in a printing unit of a web-processing rotary printing machine. The element includes a structure formed of material permitting radial expansion of the sleeve-shaped printing element, the carrying cylinder has an elongated axial extent and being formed with ducts for discharging an expansion medium. The ducts open on a circumferential surface of the carrying cylinder, and the expansion medium is pressurizable by a pressure source. The sleeve-shaped printing element is formed with an inner diameter increasing from one end to the other end of the printing element, and is formed with an at least approximately constant wall thickness; and a combination of the printing element and the carrying cylinder.

9 Claims, 4 Drawing Sheets p
1
2
3
4
5
6
7
8
9
10
11
12
13
14
15
16
17
18
19
20
21
22
23
24
A
B
C
$v_A$
$v_B$
$v_C$
$p_A$
$p_B$
$p_C$ p
1
2
3
7
10
37
11
5
4
9
24
32.1
32
30
15
33
31.1
31
38
12
8
8
6
14
17
18
21'
34
22
20
19
36
35
VA
VB
VC
A
B
C
pA
pB
pC p
1
2
3
39
7
10
11
37
5
C
pC
22
VC
21''
24
32.1
32
4
9
B
pB
VB
18
20
30
34
19
A
pA
VA
17
33
14
8
8
36
35
6
12
31.1
31
38

SLEEVE-SHAPED TRANSFER ELEMENT FOR ROTARY PRINTING MACHINES

BACKGROUND OF THE INVENTION

Field of the Invention

The invention relates to a sleeve-shaped transfer element for rotary printing machines such as web-processing rotary printing machines, wherein printing material webs are printable on one or more sides thereof.

The Swiss Patent 345 023 is concerned with a rotary printing machine having at least two rollers, which are arranged so that they can be pressed against one another while rotating and, respectively, accommodate sleeves which are mounted on carrying parts mutually connected by intermeshing gears. In order to adjust the circumferential length of at least one of the rollers, the sleeve of the respective roller is formed with a conically tapering bore. The sleeve is press fitted on the carrying part which is configured with the conical taper, the sleeve being expansible in order to increase the circumferential surface thereof. Devices are provided for infeeding a pressure fluid between the sleeve and the carrying part, in order to permit a relative axial adjusting movement between the sleeve and a shaft.

The published European Patent Document EP 0 000 410 A1 and the Swiss Patent 646 377 are concerned with a rotary printing cylinder including a conically tapering carrying cylinder and a printing sleeve carried thereby. The printing sleeve has an inner taper corresponding to the conical outer surface of the carrying cylinder and an outer, cylindrical printing jacket surface carrying the desired printing pattern. In addition, the printing sleeve has an inner layer of nickel and an outer layer of copper applied thereto. The nickel layer and the connecting surface facing the cylinder and belonging to the copper layer have a conical form, the surface of the copper layer facing away from the cylinder extending cylindrically. According to this construction, the nickel layer has a thickness of 0.05 to 0.4 mm, while the copper layer has a thickness of 0.1 to 3 mm. Provided on the carrying cylinder are a plurality of radial ducts connecting the surface of the cylinder with a central axial bore which is open towards one cylinder end. The openings of the radial ducts from the cylinder surface are primarily provided on the thicker half of the conical cylinder.

As a rule, gravure printing cylinders are engraved outside rotary printing machines suitable for gravure printing or are provided with sleeve-shaped printing elements outside the printing units of these printing machines. In the case of web-processing rotary offset printing machines, sleeve-shaped printing elements can be pushed onto a printing unit cylinder after one end of the latter has been exposed. The printing elements of sleeve-shaped configuration are pushed laterally onto the circumferential surface of the printing unit cylinder, the sleeve-shaped printing element being expanded in the radial direction by an expansion medium, such as compressed air, during the mounting.

Laterally pushing sleeve-shaped printing elements having a constant inner diameter onto a respective cylinder does not present any kind of problem in the case of carrier cylinders such as printing unit cylinders, as long as the length of the carrying cylinder is limited. In the case of those rotary printing machines which include carrying cylinders having an axial length greater than 1.50 m to 2 m, sleeve-shaped printing elements made conventionally with constant inner diameter can no longer be mounted quickly, because the pressure drop of the expansion medium over the mounting length results in the end of the sleeve-shaped printing element already pushed onto the circumferential surface of the carrying cylinder being no longer sufficiently expanded, and bearing on the circumferential surface of the carrying cylinder and jamming the latter.

One possibility for remedying this problem would be increasing the pressure at the compressed air source, but this would entail considerably larger dimensioning thereof. This is disadvantageous with regard to the required adjusting area of the pressure source; considerably more advantageous would be a feed from the compressed air network of the graphical operation. A further disadvantage of the pressure increase at the pressure source is that a development of noise during the mounting operation of the sleeve-shaped printing element would by far exceed a reasonable extent that could be tolerated over a relatively long time period.

SUMMARY OF THE INVENTION

In view of the outlined prior art and of the indicated technical problem, it is an object of the invention to provide a sleeve-shaped transfer element, such as a sleeve-shaped printing element, for rotary printing machines, which affords a simple and quick mounting thereof on a carrying cylinder having a relatively large axial or longitudinal extent.

With the foregoing and other objects in view, there is provided, in accordance with one aspect of the invention, there is provided a sleeve-shaped printing element for mounting on a carrying cylinder in a printing unit of a web-processing rotary printing machine, comprising a structure formed of material permitting radial expansion of the sleeve-shaped printing element, the carrying cylinder having an elongated axial extent and being formed with ducts for discharging an expansion medium, the ducts opening on a circumferential surface of the carrying cylinder, and the expansion medium being pressurizable by a pressure source, the sleeve-shaped printing element being formed with an inner diameter increasing from one end to the other end of the printing element, and being formed with an at least approximately constant wall thickness.

In accordance with another feature of the invention, the one end is the operating-side end, and the other end is the drive-side end of the sleeve-shaped printing element.

In accordance with a further feature of the invention, the sleeve-shaped printing element, as a rubber blanket sleeve, has a carrying layer and at least one layer of elastic covering.

In accordance with an added feature of the invention, the carrying layer is an expansible nickel layer formed by electrodeposition.

In accordance with an additional feature of the invention, the printing element is configured as a printing form sleeve.

In accordance with another aspect of the invention, there is provided a combination of the sleeve-shaped printing element with the carrying cylinder, wherein the sleeve-shaped printing element is accommodated on the carrying cylinder, and the carrying cylinder has a diameter of constant length.

In accordance with yet another feature of the invention, the drive-side end has an inner diameter exceeding the inner diameter of the operating-side end of the sleeve-shaped printing element by an amount which minimizes a required expansion at the drive-side end of the circumferential surface of the carrying cylinder.

In accordance with yet a further aspect of the invention, there is provided a sleeve-shaped printing element serving as one of a transfer cylinder sleeve and a printing-form cylinder sleeve on a carrying cylinder of a web-processing rotary printing machine, comprising devices for radial expansion of the sleeve-shaped printing element as it is being mounted on the carrying cylinder, the sleeve-shaped printing element having material characteristics varying in a direction of mounting thereof on the carrying cylinder so that a drive-side end of the sleeve-shaped printing element is more readily expansible than an operating-side end thereof.

In accordance with yet an added feature of the invention, the sleeve-shaped printing element comprises a wall having a thickness which is at least approximately constant in the mounting direction.

In accordance with a concomitant feature of the invention, the carrying cylinder whereon the sleeve-shaped printing element is mounted has a diameter of constant length.

Thus a first embodiment of the invention offers the advantages that, by having the inner diameter of the sleeve-shaped printing element increase continuously from the operating side to the drive side of the sleeve-shaped printing element, even with low expansion forces resulting from low internal pressures, an expansion at the drive-side end of the sleeve-shaped pressure element can be achieved which is adequate for preventing jamming due to friction. As a result, on the one hand, the pressure level of the pressure source pressurizing the circumferential surface of the carrying cylinder can be maintained, and on the other hand, an operation for mounting the sleeve-shaped printing element, whether it is a transfer cylinder sleeve or a printing-form cylinder sleeve, is possible on printing unit cylinders of rotary offset printing machines having an axial longitudinal extent up to 2,000 mm and more, for example, 1,905 mm. The dimension of the inner diameter of the sleeve-shaped printing element at the drive-side end is, in this regard, selected so that, after the pressure source has been switched off and the radial expansion of the sleeve-shaped printing element has therefore been canceled, the frictional fit on the circumferential or jacket surface of the printing cylinder is assured even at the drive-side end of the printing cylinder, so that migration of the sleeve-shaped printing element in the circumferential direction of the carrying cylinder, whether it is a transfer cylinder or a printing-form cylinder, is prevented in the printing unit of a web-processing rotary offset printing machine. The diameter of the printing cylinder can be up to 400 mm and more, for example, 394.7 mm.

Developing the concept upon which the invention is based, one end of the sleeve-shaped printing element is the operating-side end, the other end with a diameter expanded in comparison with the operating-side end being the drive-side end of the sleeve-shaped printing element. The sleeve-shaped printing element can be constructed either as a transfer cylinder sleeve with a carrying layer and a single-layer or multi-layer elastic covering accommodated thereon; in addition, a configuration of the sleeve-shaped printing element configured in accordance with the invention as a printing-form sleeve is possible. If the sleeve-shaped printing element is configured as a rubber blanket sleeve with a carrying layer accommodating an elastic single-layer or multi-layer covering, the carrying layer can be composed of an expansible nickel layer formed by electrodeposition.

The sleeve-shaped printing elements are preferably accommodated on carrying cylinders in printing units of rotary offset printing machines for web processing, which are formed with a diameter of constant length over the axial length of the carrying cylinder.

The increase in inner diameter provided at the drive-side end of the sleeve-shaped printing element exceeds the inner diameter at the operating-side end of the sleeve-shaped printing element by an extent which minimizes the expansion at the drive-side end of the circumferential or jacket surface of the carrying cylinder which is required during the mounting. This ensures that, even with a low pressure level established at the drive-side end of the circumferential or jacket surface of the carrying cylinder, an expansion preventing contact with the circumferential surface of the carrying cylinder is assured at the drive-side end of the sleeve-shaped printing element.

An alternative construction of the invention offers the advantage of an easier expansion of the drive-side region of the sleeve-shaped printing element, i.e., when sleeve-shaped printing elements are being pushed onto carrying cylinders of relatively great axial length, such as printing unit cylinders of rotary printing machines, jamming of the sleeve in the end region of the mounting path can be avoided. By the course of the material characteristics over the axial length of the sleeve-shaped printing element, the expansion force required to expand the sleeve-shaped printing element in the radial direction can be applied even by lower pressures of the expansion medium issuing from the circumferential or jacket surface of the carrying cylinder.

In an advantageous embodiment of this alternative construction of the concept upon which the invention is based, the wall thickness of the sleeve-shaped printing element is at least approximately constant in the mounting direction. The sleeve-shaped printing element according to this embodiment of the concept upon which the invention is based is preferably mounted on a carrying cylinder, whether it is a transfer cylinder or a printing-form cylinder of a printing unit of a web-processing rotary offset printing machine.

Other features which are considered as characteristic for the invention are set forth in the appended claims.

Although the invention is illustrated and described herein as embodied in a sleeve-shaped transfer element for rotary printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figures 1A, 1B:
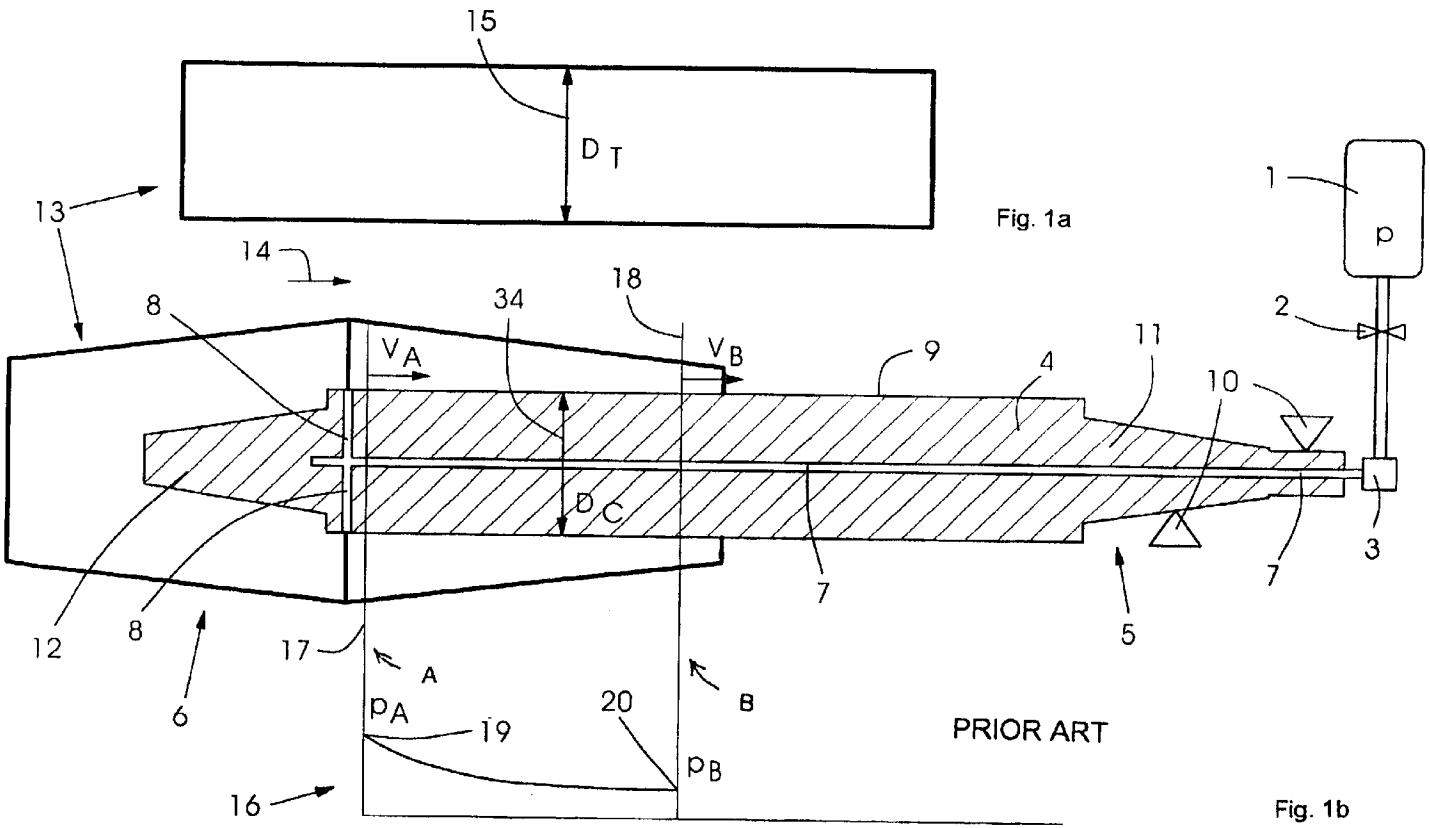
FIG. 1*a* is a diagrammatic view of a sleeve-shaped printing element with a constant inner diameter.
FIG. 1*b* shows the expansion and application of the sleeve-shaped printing element onto a carrying cylinder, both figures being in accordance with the prior art.

Referring now to the drawings and, first, particularly to FIGS. 1*a,* 1*b,* 2*a* and 2*b* thereof, there is shown therein the expansion and application of a conventional sleeve-like printing element formed with a constant inner diameter on a carrying cylinder.

Figures 2A, 2B:
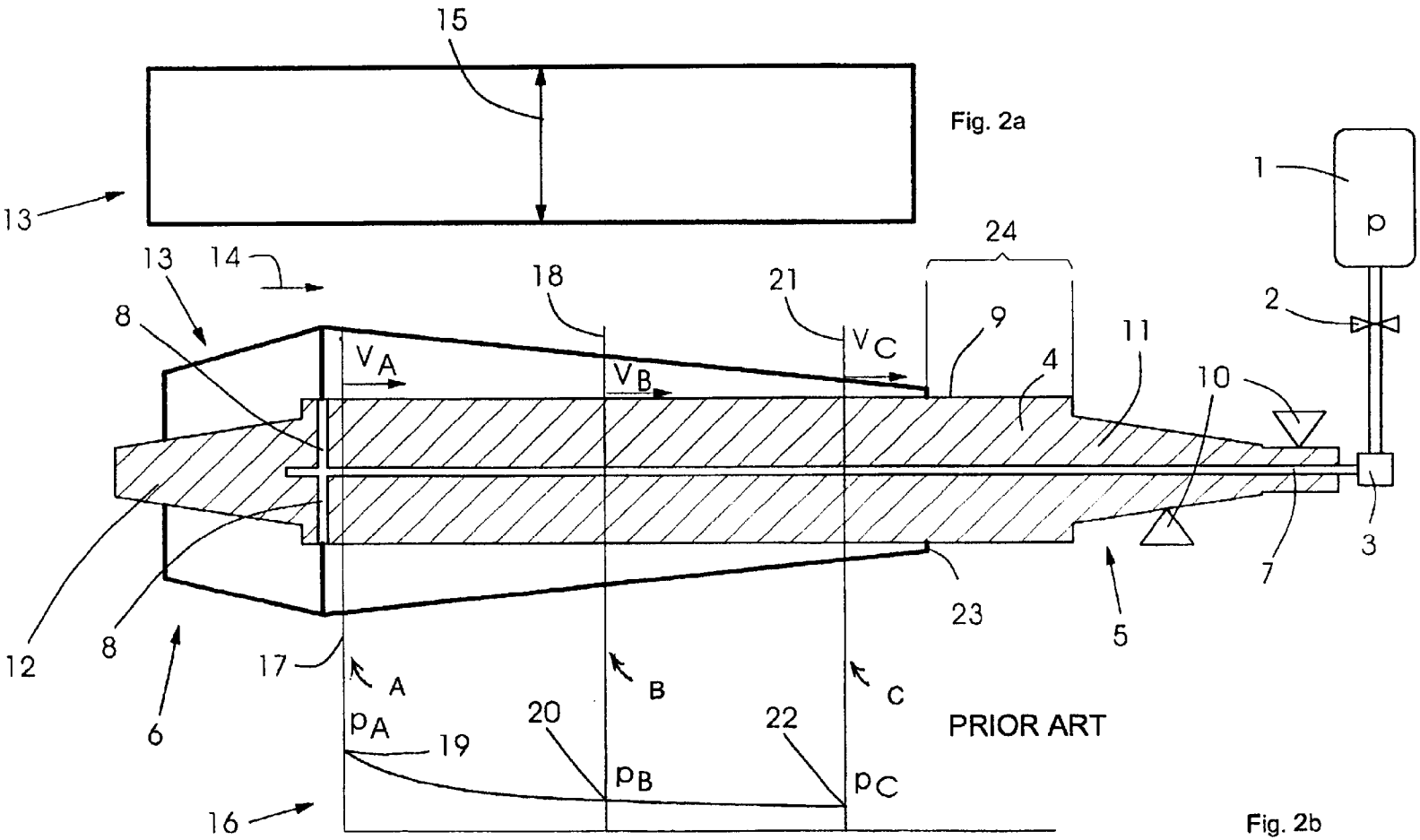
Fig. 2b PRIOR ART
FIG. 2*a* is another view similar to that of FIG. 1*a,* and FIG. 2*b* shows the sleeve-shaped printing element being blocked during the mounting thereof on the carrying cylinder, the printing element formed with a constant inner diameter being further pushed onto the carrying cylinder, both figures being also in accordance with the prior art.

According to this construction heretofore known in the prior art, a pressure source 1 is provided which impresses a pressure level of about 10 bar onto an expansion medium. As a rule, the pressure source 1 according to FIGS. 1*b* and 2*b* is a compressed air source. The expansion medium flows from the pressure source 1 via a control valve 2 to a connecting piece 3, from which the expansion medium flows into a central bore 7 formed in a carrying cylinder 4. From the central bore 7, which passes through the interior of the carrying cylinder 4, a multiplicity of radial ducts 8 branch off at the operating-side end of the carrying cylinder 4 and open out from the carrying cylinder 4 at the jacket or circumferential surface 9 thereof. Through the radial ducts 8 opening at the operating-side end of the carrying cylinder 4, the expansion medium emerges, by which a cylindrical sleeve element 13 to be mounted on the circumferential or jacket surface 9 of the carrying cylinder 4 is expanded in radial direction and is subsequently pushed onto the circumferential or jacket surface 9 of the carrying cylinder 4 in a mounting direction represented by the arrow 14.

The carrying cylinder 4 reproduced diagrammatically in FIGS. 1*b* and 2*b* can be either a printing-form cylinder of a printing unit of a rotary offset printing machine or a transfer cylinder of a web-processing rotary offset printing machine. For the purpose of mounting the cylindrical printing element 13 on the circumferential or jacket surface 9 of the carrying cylinder 4, i.e., for pushing it on laterally, a preferably conical cylinder journal 12 of the carrying cylinder 4 on the operating side thereof is released from mounting elements thereof via a device not specifically illustrated here, so that the carrying cylinder 4 is accessible from the exposed end thereof. In order to maintain the carrying cylinder 4 in a horizontal position thereof, locking devices 10 are assigned to a journal 11 on the drive side of the carrying cylinder 4, by which devices the drive-side mounting 5 serving, via the locking devices 10, to hold in horizontal position the carrying cylinder 4 released on the operating side thereof. The details of the operating-side mounting 6 are not illustrated here in the interest of simplicity.

After the cylinder journal 11 on the drive-side mounting 5 has been locked by the locking devices 10, the compressed air source 1 is activated, i.e., expansion medium flows out through the central bore and the radial ducts 8 in a partial circumferential region of the circumferential or jacket surface 9 of the carrying cylinder 4. The cylindrical sleeve element 13, formed with a constant inner diameter 15, is then pushed onto the circumferential surface 9 of the carrying cylinder 4 in the mounting direction represented by the arrow 14 from the operating-side mounting 6. In the region of the radial ducts 8, an expansion of the cylindrical element 13 occurs, as identified by reference numeral 17. In the region of the radial ducts 8, the pressure level $p_A$ at the position A is at the greatest value thereof on the first pressure curve 16 plotted over the travel in the mounting direction 14. In accordance with the onpushing operation performed in the mounting direction 14, the pressure level $p_A$ decreases in the direction towards the drive-side mounting 5 of the carrying cylinder 4, in which regard, note a comparison with the expansion pressure $p_B$ at the position B. Therefore, the radial expansion 18 of the cylindrical sleeve element 13 that can be attained at the position B also decreases. FIG. 2*b* shows the further progress of the mounting operation 6 of the conventional cylindrical sleeve element 13 on the circumferential or jacket surface 9 of the carrying cylinder 4.

According to FIG. 2*b,* the cylindrical sleeve element 13 formed with a constant inner diameter 15 (note FIG. 2*a*) has been pushed about ¾ of the way onto the circumferential or jacket surface 9 of the carrying cylinder 4. At the position A, a maximum radial expansion 17 of the cylindrical sleeve element 13 continues to prevail at the pressure $p_A$ as a result of the expansion pressure p. The radial expansion at position B pressure $p_B$ at the position B is identified by reference character 18; the expansion pressure $p_B$ associated therewith is identified by reference numeral 20. As viewed in the mounting direction 14 of the cylindrical sleeve element 13, the radial expansion pressure decreases further to $p_C$ at the position C (note the radial expansion 21). The expansion pressure $p_C$ exists at the position C or at 22, corresponding to the first pressure curve 16 in FIG. 2*b*. An onpushing operation carried out in the mounting direction represented by the arrow 14 and going beyond the position C is blocked as a result of a contact 23 between the drive-side end of the cylindrical sleeve element 13 and the circumferential or jacket surface 9 of the carrying cylinder 4. Beginning at the position 22 and in the adjacent circumferential or jacket surface region 24, the internal pressure produced by the compressed air source 1 and required for the radial expansion of the cylindrical sleeve element 13 no longer suffices for radial expansion of the cylindrical sleeve element 13 as it is pushed onto a carrying cylinder 4 with a relatively great axial length.

Figures 3A, 3B:
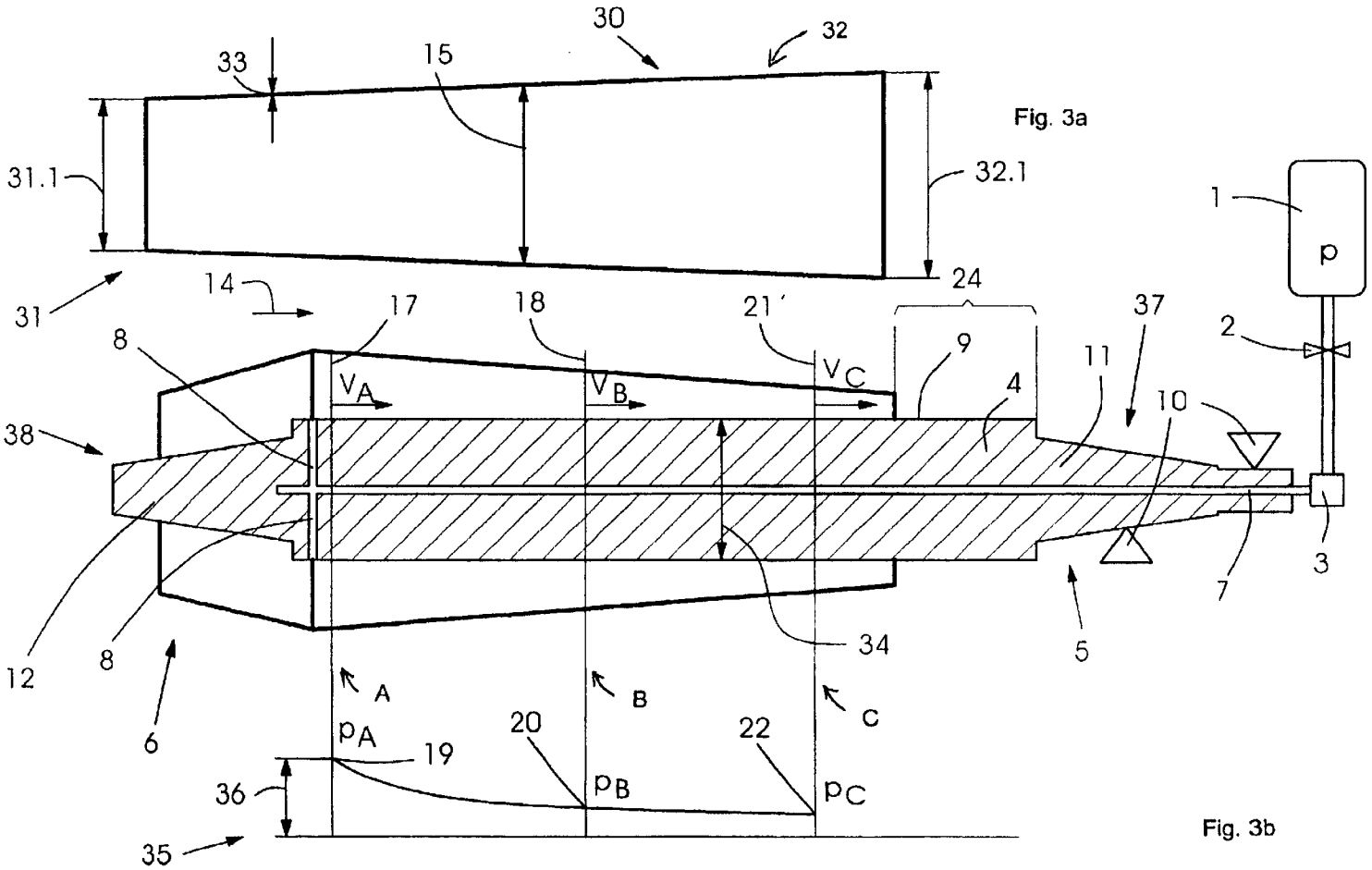
FIG. 3*a* is a diagrammatic view corresponding to that of FIG. 1*a* of a printing element configured in accordance with the invention of the instant application.
FIG. 3*b* shows the expansion and application of the novel printing element onto the jacket or circumferential surface of a carrying cylinder.

FIGS. 3*a* and 3*b* reveal the expansion and application of printing element configured in accordance with the invention of the instant application onto the circumferential or jacket surface 9 of a carrying cylinder 4.

According to FIG. 3*a,* a sleeve-shaped printing element 30 is provided with a variable course of the inner diameter 15 from the operating-side end 31 to the drive-side end 32 of the printing element 30. The sleeve-shaped printing element 30 is formed with an at least approximately constant wall thickness 33. The inner diameter 31.1 at the operating-side end 31 of the sleeve-like printing element 30 is smaller than the drive-side inner diameter 32.1 at the drive-side end 32 of the sleeve-shaped printing element 30. As shown in FIG. 3*b,* the sleeve-shaped printing element 30, which has an inner diameter 15 increasing continuously from the operating-side end 31 to the drive-side end 32, is mounted on a carrying cylinder 4 of a printing unit of a web-processing rotary offset printing machine, the carrying cylinder 4 having a diameter 34 preferably remaining at least approximately constant over the axial length of the carrying cylinder 4. In a manner analogous to the mounting operations of a conventional sleeve-shaped printing element on the circumferential or jacket surface 9 of a carrying cylinder 4 according to FIGS. 1 and 2, the circumferential or jacket surface 9 of the carrying cylinder 4 is pressurized by activating the pressure source 1 and by discharging expansion medium, for example, compressed air, which emerges at the circumferential or jacket surface 9 through the radial ducts 8.

At the released end 38 of the carrying cylinder 4, the sleeve-shaped printing element 30 is pushed onto the carrying cylinder 4 in the mounting direction represented by the arrow 14 over the preferably conical cylinder journal 12 on the operating side of the carrying cylinder 4. Maximum radial expansion 17 occurs at 19 at the position A, analogous to FIGS. 1*b* and 2*b*; the pressure $p_A$ prevailing at the position A is identified by reference numeral 19 in the second pressure curve 35. As viewed in the mounting direction 14 of the sleeve-shaped printing element 30, radial expansion 18 of the sleeve-shaped printing element 30 occurs at 20 in position B on the circumferential surface 9 of the carrying cylinder 4. The expansion pressure corresponding to position B is identified in accordance with the second pressure curve 35. In position C at 22 of the sleeve-shaped printing element 30 on the circumferential surface 9 of the carrying cylinder 4, the radial expansion which is established is identified by reference character 21'. Due to the construction of the drive-side end 32 of the sleeve-shaped printing element 30 with an enlarged inner diameter 32.1, this expansion is significantly greater in comparison with the expansion 21 of the cylindrically configured printing element 13. The expansion pressure which is established at the position 22 on the circumferential or jacket surface 9 of the carrying cylinder 4, in the second pressure curve 35 plotted against the mounting direction represented by the arrow 14 and located at the bottom of FIG. 3, is approximately at the same pressure level as the pressure at the position 22 according to FIG. 2.

While the sleeve-shaped printing element 30 is being pushed laterally onto the circumferential or jacket surface 9 of the carrying cylinder 4, whether the latter is a transfer cylinder or a printing plate cylinder of a printing unit of a web-processing rotary offset printing machine, the locking devices 10 securing the conical journal 11 of the carrying cylinder 4 assume the activated position 37 thereof. As a result, during the mounting operation of the sleeve-shaped printing element 30, the carrying cylinder 4 is supported and secured in the printing unit.

Figures 4A, 4B:
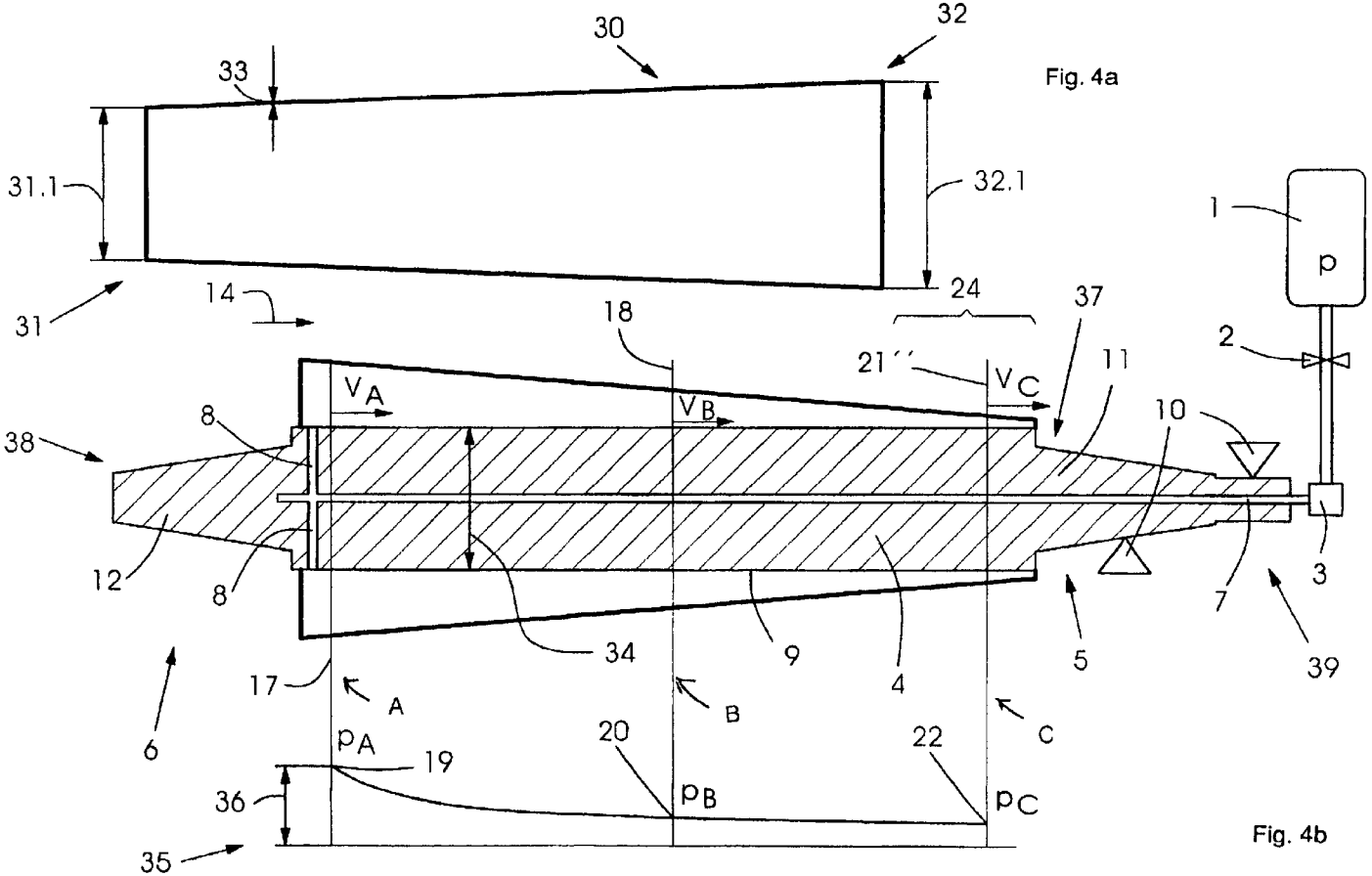
FIG. 4*a* is another view corresponding to that of FIG. 3*a,* and FIG. 4*b* shows the printing element constructed in accordance with the invention more readily having reached the end position thereof on the jacket or circumferential surface of the appertaining carrying cylinder.

FIGS. 4*a* and 4*b* show the printing element constructed in accordance with another embodiment of the invention more readily reaching the end position thereof on the jacket or circumferential surface of the appertaining carrying cylinder.

According to FIGS. 4*a* and 4*b*, the sleeve-shaped printing element 30 formed with a constant wall thickness 33 and a variable inner diameter 15 that increases from the operating-side end 31 to the drive-side end 32, has been pushed completely onto the circumferential surface 9 of the carrying cylinder 4. The carrying cylinder 4 is held at least approximately in horizontal direction at the drive-side mounting 5 thereof by locking devices 10 set into the activated position 37, while the non-illustrated operating-side mounting 6 of the carrying cylinder 4 has released the conical journal 12 of the carrying cylinder 4 on the operating side. Assisted by the construction of the drive-side end 32 of the sleeve-shaped printing element 30 of enlarged inner diameter 32.1, a radial expansion 21" is established in the position C on the circumferential or jacket surface 9 of the carrying cylinder 4. This expansion is dimensioned so that at the pressure $p_C$ of the expansion medium that prevails thereat (note reference numeral 22), contact between the circumferential or jacket surface 9 of the carrying cylinder 4 and the inner side of the sleeve-shaped printing element 30 just does not occur. Due to the enlarged inner diameter 32.1 at the drive-side end 32 of the sleeve-shaped printing element 30, the expansion pressure 22 ($p_C$) of the expansion medium that prevails at the position C on the circumferential or jacket surface 9 of the carrying cylinder 4 is dimensioned so that reaching the drive-side end face of the carrying cylinder 4 of the sleeve-shaped printing element 30 in the mounting direction 14 can be realized without contact between the printing element 30 and the circumferential or jacket surface 9 of the carrying cylinder 4. Reference numeral 37 identifies a volumetric flow of the expansion medium flowing away at the drive-side mounting 5, the volumetric flow 37, when compared with the volumetric flow of the expansion medium flowing away on the operating-side mounting 6, being, however, significantly lower.

The amount by which the inner diameter of the sleeve-shaped printing element 30 of variable inner diameter 15 at the drive-side end 32 thereof exceeds the inner diameter 31.1 at the operating-side end 31 is dimensioned so that, after the pressure source 1 has been switched off, even at the position 22 on the circumferential or jacket surface 9 of the carrying cylinder 4, assurance is provided that a frictional connection occurs thereat between the inside of the printing element 30 configured like a sleeve and the circumferential or jacket surface 9 of the carrying cylinder 4, which prevents migration of the sleeve-shaped printing element 30, whether it is a transfer cylinder sleeve or a printing-form cylinder sleeve, in the circumferential direction on the circumferential or jacket surface 9 of the carrying cylinder 4. By using the construction proposed by the invention in accordance with the first embodiment, sleeve-shaped printing elements 30 can be mounted on the circumferential or jacket surface 9 of a carrying cylinder 4 in one operation. Clamping of the inner surface and excessive wear thereof as a result of insufficient expansion of the drive-side end 32 of the sleeve-shaped printing element 30 is then prevented by the configuration proposed by the invention of the sleeve-shaped printing element 30, formed with an at least approximately constant wall thickness 33. The enlargement 32.1 in the diameter provided at the drive-side end 32 of the sleeve-shaped printing element 30 permits the radial expansion 21" of the sleeve-shaped printing element even towards the end of the mounting travel in the region 24, the region adjacent to the drive-side mounting 5 of the carrying cylinder 4.

According to a further alternative construction according to the invention, the sleeve-shaped printing element 30 can be provided with material characteristics which vary over the axial length of the sleeve-shaped printing element. By the material characteristics which vary over the length of the sleeve-shaped printing element 30, the drive-side end 32 of the sleeve-shaped printing element 30 can be expanded significantly more readily than the operating-side end 31 of the printing element 30 of sleeve-shaped configuration. As a result, when relatively long sleeve-shaped printing elements 30 are being pushed in the mounting direction represented by the arrow 14 onto the circumferential or jacket surface 9 of the carrying cylinder 4, sufficient radial expansion is produced towards the end of the onpushing travel, so that the risk of clamping of the inner side of the sleeve-shaped printing element 30 on the circumferential or jacket surface 9 of the carrying cylinder 4 is prevented. In addition, according to this alternative construction of the embodiment of the invention, the sleeve-shaped printing element 30 having material characteristics varying over the axial length is fabricated with an at least approximately constant wall thickness 33. The sleeve-shaped printing element 30 with material characteristics varying over the axial length is preferably used on a carrying cylinder 4 of a printing unit of a web-processing rotary offset printing machine, wherein the carrying cylinder 4 has a diameter 34 at least approximately constant over the axial length of the cylinder 4.

I claim:

1. In a printing unit of a web-processing rotary printing machine, an assembly comprising a sleeve-shaped printing element, a carrying cylinder having a an outer circumferential surface of constant diameter for accommodating said sleeve-shaped printing element, a structure formed of material permitting radial expansion of said sleeve-shaped printing element, said carrying cylinder having an elongated axial extent and ducts for discharging an expansion medium, said ducts opening on said circumferential surface of said carrying cylinder, and the expansion medium being pressurizable by a pressure source, said sleeve-shaped printing element being constructed with an inner diameter increasing from one end to the other end of said printing element and being constructed with an at least approximately constant wall thickness.

2. The assembly according to claim 1, wherein said one end is the operating-side end, and said other end is the drive-side end of said sleeve-shaped printing element.

3. The assembly according to claim 1, comprising, as a rubber blanket sleeve, a carrying layer and at least one layer of elastic covering.

4. The assembly according to claim 3, wherein said carrying layer is an expansible nickel layer formed by electrodeposition.

5. The assembly according to claim 1, wherein said printing element is configured as a printing form sleeve.

6. The assembly according to claim 2, wherein said drive-side end has an inner diameter exceeding the inner diameter of said operating-side end of said sleeve-shaped printing element by an amount which minimizes a required expansion at said drive-side end of the circumferential surface of said carrying cylinder.

7. In a web-processing rotary printing machine, an assembly comprising a sleeve-shaped printing element serving as a blanket sleeve, said sleeve-shaped printing element having a drive-side end and an operating side end, a carrying cylinder having a drive side, an operating side and an outer circumferential surface of constant diameter whereon said sleeve-shaped printing element is mounted, devices for radial expansion of said sleeve-shaped printing element being mounted on said carrying cylinder in a given direction of mounting, said devices for radial expansion including radial ducts at said operating side, said sleeve-shaped printing element having material characteristics varying in the direction of mounting thereof on said carrying cylinder so that said drive-side end of the sleeve-shaped printing element is more readily expandable than said operating-side end thereof.

8. The assembly according to claim 7, comprising a wall having a thickness which is at least approximately constant in said mounting direction.

9. In a printing unit of a web-processing rotary printing machine, an assembly comprising a sleeve-shaped printing element, a carrying cylinder having a drive side, an operating side and an outer circumferential surface of constant diameter for accommodating said sleeve-shaped printing element, a structure formed of material permitting radial expansion of said sleeve-shaped printing element, said carrying cylinder having an elongated axial extent and ducts for discharging an expansion medium, said ducts opening on said circumferential surface of said carrying cylinder at said operating side, and the expansion medium being pressurizable by a pressure source, said sleeve-shaped printing element being constructed with an inner diameter increasing from one end to the other end of said printing element and being constructed with an at least approximately constant wall thickness.

* * * * *